US011441501B2

(12) United States Patent
Suzuki et al.

(10) Patent No.: US 11,441,501 B2
(45) Date of Patent: Sep. 13, 2022

(54) CONTROLLER FOR VEHICLE AND METHOD FOR CONTROLLING VEHICLE

(71) Applicant: TOYOTA JIDOSHA KABUSHIKI KAISHA, Toyota (JP)

(72) Inventors: Takashi Suzuki, Miyoshi (JP); Akihiro Kaneko, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 17/558,701

(22) Filed: Dec. 22, 2021

(65) Prior Publication Data

US 2022/0220911 A1 Jul. 14, 2022

(30) Foreign Application Priority Data

Jan. 8, 2021 (JP) ..... JP2021-002106
Sep. 30, 2021 (JP) ..... JP2021-161864

(51) Int. Cl.
*F02D 41/00* (2006.01)
*F02D 35/02* (2006.01)
*F02D 41/14* (2006.01)

(52) U.S. Cl.
CPC ..... *F02D 41/009* (2013.01); *F02D 35/024* (2013.01); *F02D 41/0097* (2013.01);
(Continued)

(58) Field of Classification Search
CPC .. F02D 35/024; F02D 41/009; F02D 41/0097; F02D 41/14; F02D 41/1401;
(Continued)

(56) References Cited

U.S. PATENT DOCUMENTS 9,227,636 B2 * 1/2016 Yamamoto ..... F16H 63/486
2003/0154945 A1 * 8/2003 Ando ..... B60K 6/445 903/945

(Continued)

FOREIGN PATENT DOCUMENTS

EP 1 965 066 A1 9/2008
JP 2002-371906 A 12/2002

(Continued)

*Primary Examiner* — John Kwon
*Assistant Examiner* — Johnny H Hoang
(74) *Attorney, Agent, or Firm* — Finnegan, Henderson, Farabow, Garrett & Dunner, LLP

(57) ABSTRACT

A controller performs a rotation angle deriving process that derives a value of the rotation angle of a crankshaft by each specified angle that is smaller than a predetermined angle by performing a Hilbert process on a detection signal from a crankshaft sensor, an angular velocity deriving process that derives an angular velocity of the crankshaft as an engine angular velocity from the value of the rotation angle of the crankshaft by each specified angle, an inertia torque calculation process that calculates an engine inertia torque from the engine angular velocity, a resonance effect torque calculation process that calculates a resonance effect torque, and an engine torque calculation process that calculates a sum of the resonance effect torque and the engine inertia torque as an engine torque that is an output torque of the engine.

7 Claims, 6 Drawing Sheets

(52) U.S. Cl.
CPC .... *F02D 41/1401* (2013.01); *F02D 2200/101* (2013.01); *F02D 2200/1002* (2013.01)

(58) Field of Classification Search
CPC ..... F02D 41/1424; F02D 2200/1002; F02D 2200/101
USPC ..... 701/101–102, 110–114
See application file for complete search history.

(56) References Cited

U.S. PATENT DOCUMENTS

| | | | | |
|---|---|---|---|---|
| 2009/0308145 | A1 | 12/2009 | Suzuki | |
| 2018/0088144 | A1* | 3/2018 | Hojo | G01P 3/488 |

FOREIGN PATENT DOCUMENTS

| | | | |
|---|---|---|---|
| JP | 2008-057492 | A | 3/2008 |
| JP | 2008-248877 | A | 10/2008 |

* cited by examiner

CONTROLLER FOR VEHICLE AND METHOD FOR CONTROLLING VEHICLE

RELATED APPLICATIONS

The present application claims priority of Japanese Patent Application Number 2021-002106 filed on Jan. 8, 2021 and Japanese Patent Application Number 2021-161864 filed on Sep. 30, 2021, each of which is hereby incorporated by reference herein in its entirety.

BACKGROUND

1. Field

The following description relates to a controller for a vehicle and a method for controlling a vehicle.

2. Description of Related Art

Japanese Laid-Open Patent Publication No. 2008-248877 discloses a vehicle including an engine, a drive force transmitting device, and a damper that connects the engine and the drive force transmitting device. The damper is connected to the crankshaft of the engine. The damper is connected to the input shaft of the drive force transmitting device.

The above vehicle includes a controller that calculates engine torque. The controller calculates the sum of an engine inertia torque and a resonance effect torque as the engine torque.

The engine inertia torque is calculated from the time derivative of the angular velocity of the crankshaft.

The resonance effect torque will now be described. The output of the engine is input to the input shaft of the drive force transmitting device via the damper. When the engine torque varies, the damper may generate torsional vibration, and resonance resulting from the torsional vibration may be generated in the input shaft of the drive force transmitting device. When such resonance is generated in the input shaft of the drive force transmitting device, a resonance effect torque, which is torque resulting from the resonance, is input to the crankshaft. This will fluctuate the angular velocity of the crankshaft.

As described above, the engine inertia torque is calculated from the time derivative of the angular velocity of the crankshaft. The angular velocity of the crankshaft is calculated from the time derivative of a crank angle. The above controller obtains the crank angle by each predetermined angle. Thus, the resolution of the engine inertia torque is limited by the size of the predetermined angle at which the crank angle is obtained. When the engine torque calculated from the engine inertia torque is used for control, the calculated engine torque may not have sufficient resolution.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a controller for a vehicle is provided. The vehicle includes an engine with cylinders, a damper connected to a crankshaft of the engine, a drive force transmitting device including an input shaft connected to the damper and a rotating body configured to rotate in synchronization with the input shaft, a first sensor configured to output a detection signal indicating that the crankshaft has rotated by a predetermined angle each time the crankshaft rotates by the predetermined angle, and a second sensor configured to detect a rotation angle of the input shaft or the rotating body. The controller includes processing circuitry. The processing circuitry is configured to perform: a first sensor detection signal acquisition process that obtains a detection signal from the first sensor; a first rotation angle deriving process that derives a value of a rotation angle of the crankshaft by each specified angle that is smaller than the predetermined angle by performing a Hilbert process on the detection signal from the first sensor; a first angular velocity deriving process that derives an angular velocity of the crankshaft as an engine angular velocity from the value of the rotation angle of the crankshaft by each specified angle; a first inertia torque calculation process that calculates an engine inertia torque from the engine angular velocity; a transmitting device angular velocity acquisition process that obtains an angular velocity of the input shaft or the rotating body as a transmitting device angular velocity from a detection signal from the second sensor; a resonance effect torque calculation process that calculates a resonance effect torque from the transmitting device angular velocity, the resonance effect torque resulting from resonance generated in the drive force transmitting device; and a first engine torque calculation process that calculates a sum of the resonance effect torque and the engine inertia torque as an engine torque that is an output torque of the engine.

In another general aspect, a method for controlling a vehicle is provided. The vehicle includes an engine with cylinders, a damper connected to a crankshaft of the engine, a drive force transmitting device including an input shaft connected to the damper and a rotating body configured to rotate in synchronization with the input shaft, a first sensor configured to output a detection signal indicating that the crankshaft has rotated by a predetermined angle each time the crankshaft rotates by the predetermined angle, and a second sensor configured to detect a rotation angle of the input shaft or the rotating body. The method includes: a first sensor detection signal acquisition process that obtains a detection signal from the first sensor; a first rotation angle deriving process that derives a value of a rotation angle of the crankshaft by each specified angle that is smaller than the predetermined angle by performing a Hilbert process on the detection signal from the first sensor; a first angular velocity deriving process that derives an angular velocity of the crankshaft as an engine angular velocity from the value of the rotation angle of the crankshaft by each specified angle; a first inertia torque calculation process that calculates an engine inertia torque from the engine angular velocity; a transmitting device angular velocity acquisition process that obtains an angular velocity of the input shaft or the rotating body as a transmitting device angular velocity from a detection signal from the second sensor; a resonance effect torque calculation process that calculates a resonance effect torque from the transmitting device angular velocity, the resonance effect torque resulting from resonance generated in the drive force transmitting device; and a first engine torque calculation process that calculates a sum of the resonance effect torque and the engine inertia torque as an engine torque that is an output torque of the engine.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

First Embodiment

A controller 100 for a vehicle according to a first embodiment will now be described with reference to FIGS. 1 to 5.

Figure 1:
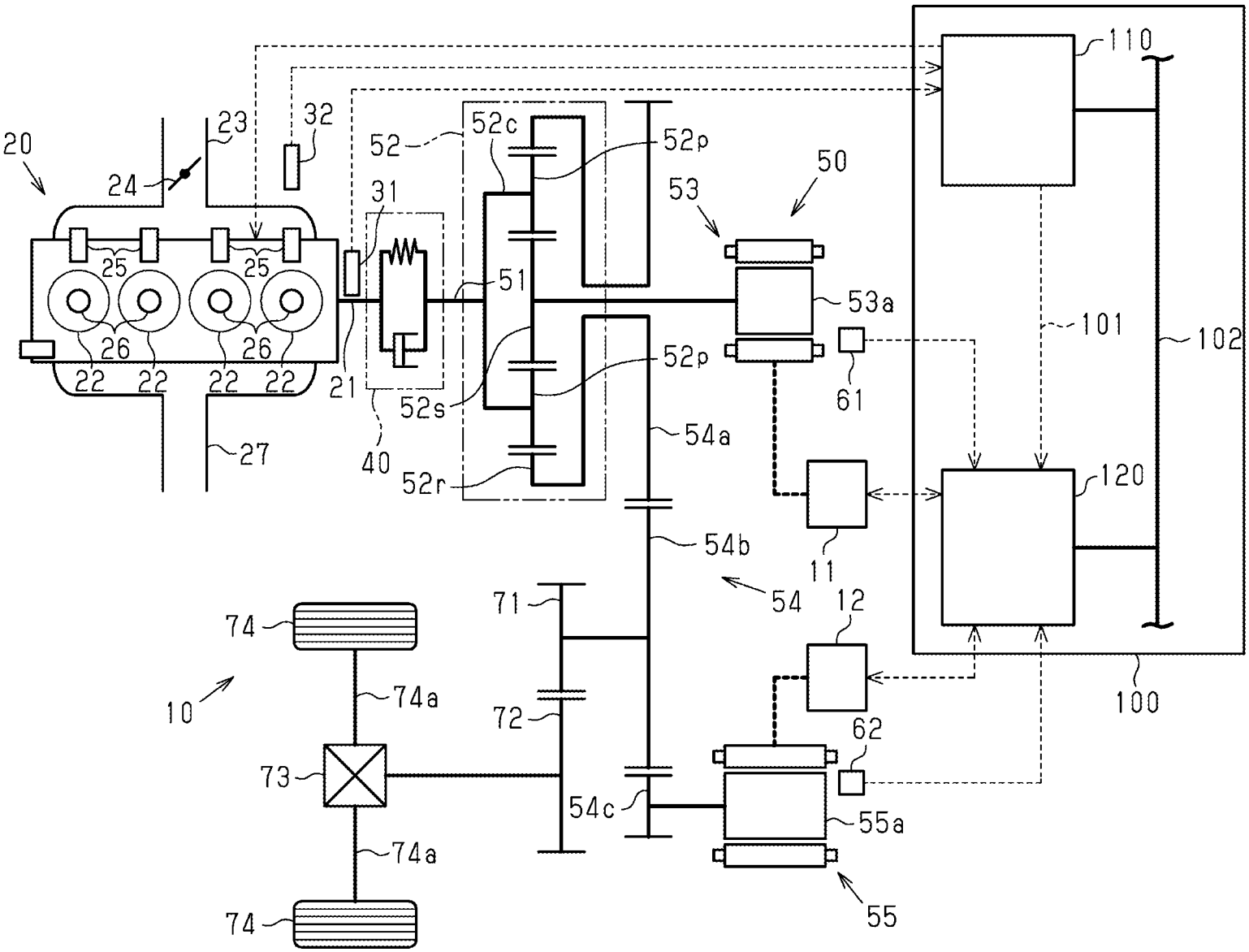
FIG. 1 is a diagram schematically showing a hybrid electric vehicle to which a controller for a vehicle according to a first embodiment is applied.

As shown in FIG. 1, the controller 100 of the present embodiment is applied to a hybrid electric vehicle 10.

The Overall Structure of Hybrid Electric Vehicle 10

The hybrid electric vehicle 10 includes an engine 20, a damper 40 connected to a crankshaft 21 of the engine 20, and a drive force transmitting device 50. The damper 40 attenuates fluctuation of torque output from the engine 20 and transmits the torque to the drive force transmitting device 50.

The engine 20 is of a spark-ignition type. The engine 20 includes cylinders 22, an intake passage 23 through which intake air is drawn into the cylinders 22, and a throttle valve 24 arranged in the intake passage 23. The throttle valve 24 adjusts an intake air amount GA, which indicates the flow rate of intake air of the intake passage 23.

The cylinders 22 of the engine 20 each include a fuel injection valve 25 and an ignition device 26. In each cylinder 22, an air-fuel mixture containing fuel injected from the fuel injection valve 25 and intake air is burned with spark discharge of ignition device 26. Such combustion of the air-fuel mixture inside the cylinder 22 reciprocates the piston of the cylinder 22 to rotate the crankshaft 21. Exhaust gas generated by the combustion of the air-fuel mixture in each cylinder 22 is discharged into an exhaust passage 27.

The engine 20 includes various types of sensors outputting detection signals to the controller 100. Examples of such sensors include a crank angle sensor 31 and a cam angle sensor 32. The crank angle sensor 31 outputs a detection signal indicating that the crankshaft 21 has rotated by a predetermined angle each time the crankshaft 21 rotates by the predetermined angle. The predetermined angle may be, for example, 30 degrees. The cam angle sensor 32 detects the rotation angle of a camshaft rotated in synchronization with the crankshaft 21 and outputs a detection signal in conformance with the rotation speed of the camshaft. In the present embodiment, crank angle sensor 31 corresponds to a first sensor.

The drive force transmitting device 50 includes an input shaft 51 connected to the damper 40 and a planetary gear mechanism 52. The planetary gear mechanism 52 includes a sun gear 52*s*, a ring gear 52*r*, and pinion gears 52*p* meshing with the sun gear 52*s* and the ring gear 52*r*. The pinion gears 52*p* are rotationally supported by a carrier 52*c* to orbit about the sun gear 52*s*. The carrier 52*c* is connected to the input shaft 51.

The drive force transmitting device 50 includes a first motor generator 53. The first motor generator 53 includes a rotor 53*a* connected to the sun gear 52*s*. That is, the first motor generator 53 is connected to the input shaft 51 by the planetary gear mechanism 52 so that the rotor 53*a* of the first motor generator 53 is rotated in synchronization with the input shaft 51.

The drive force transmitting device 50 includes a gear mechanism 54 and the second motor generator 55. The gear mechanism 54 includes a counter drive gear 54*a*, a counter driven gear 54*b*, and a reduction gear 54*c*. The counter drive gear 54*a* rotates integrally with the ring gear 52*r*. The counter driven gear 54*b* meshes with the counter drive gear 54*a*. The reduction gear 54*c* meshes with the counter driven gear 54*b*. The reduction gear 54*c* is connected to a rotor 55*a* of the second motor generator 55.

The drive force transmitting device 50 includes various types of sensors outputting detection signals to the controller 100. Examples of such sensors include a first motor angle sensor 61 and a second motor angle sensor 62. The first motor angle sensor 61 detects the rotation angle of the rotor 53*a* of the first motor generator 53 and outputs a detection signal in conformance with the rotation speed of the rotor 53*a*. The second motor angle sensor 62 detects the rotation angle of the rotor 55*a* of the second motor generator 55 and outputs a detection signal in accordance with the rotation speed of the rotor 55*a*. In the present embodiment, the first motor angle sensor 61 corresponds to a second sensor, and the rotor 53*a* of the first motor generator 53 corresponds to a rotating body rotating in synchronization with the input shaft 51. That is, the first motor angle sensor 61 corresponds to the second sensor that is configured to detect the rotation angle of the input shaft 51 or the rotating body.

The hybrid electric vehicle 10 includes a final drive gear 71, which rotates integrally with the counter driven gear 54*b*, and a final driven gear 72, which meshes with the final drive gear 71. The final drive gear 71 is connected to an axle 74*a* of drive wheels 74 by a differential mechanism 73.

The hybrid electric vehicle 10 includes a first inverter 11 for the first motor generator 53 and a second inverter 12 for the second motor generator 55. The first inverter 11 is controlled to drive the first motor generator 53. The second inverter 12 is controlled to drive the second motor generator 55.

Configuration of the Controller 100

As shown in FIG. 1, the controller 100 includes a first control device 110 that controls the engine 20 and a second control device 120 that controls the drive force transmitting device 50. The first control device 110 receives detection signals from the sensors of the engine 20. The second control device 120 receives detection signals from the sensors of the drive force transmitting device 50. Specifically, the first control device 110 receives detection signals from the crank angle sensor 31 and the cam angle sensor 32. The second control device 120 receives detection signals from the first motor angle sensor 61 and the second motor angle sensor 62.

The controller 100 includes a signal line 101 that transmits a crank counter CNTcr, which is obtained by the first control device 110, to the second control device 120. The crank counter CNTcr is a value that is incremented each time the rotation angle of the crankshaft 21 increases by a predetermined angle. The crank counter CNTcr is reset to 0 at the end of one cycle of the engine 20. The crank counter CNTcr will be incremented to, for example, 23 during one cycle of the engine 20.

The signal line 101 is a dedicated signal line that transmits the crank counter CNTcr from the first control device 110. Thus, delay that occurs when the crank counter CNTcr is transmitted to the second control device 120 through the signal line 101 is sufficiently reduced within a range not to affect various types of processes when performed based on the crank counter CNTcr.

The controller 100 includes a CAN communication line 102 that transmits various types of information between the first control device 110 and the second control device 120. The CAN communication line 102 is used to transmit information between, for example, the first control device 110 and the second control device 120 installed on the hybrid electric vehicle 10. Thus, when information obtained, for example, by the second control device 120 is transmitted to the first control device 110 through the CAN communication line 102, delay occurs between a time at which the second control device 120 transmits the information and a time at which the first control device 110 receives the information.

The first control device 110 and the second control device 120 each include a CPU, ROM, and a storage device serving as an electrically rewritable nonvolatile memory (not shown). The ROM stores a control program executed by the CPU. The storage device stores various types of calculation results by the CPU.

Processing Performed by the Controller 100

The first control device 110 of the controller 100 calculates engine torque Te, which is a calculated value of the output torque of the engine 20. The crankshaft 21 of the engine 20 is connected to the input shaft 51 of the drive force transmitting device 50 by the damper 40. Thus, the first control device 110 also uses information obtained by the second control device 120 when calculating the engine torque Te.

Processes performed by the first control device 110 and the second control device 120 to calculate the engine torque Te will now be described with reference to FIG. 2.

Processes performed by the second control device 120 will now be described.

The second control device 120 performs a motor rotation speed acquisition process M21. Specifically, the second control device 120 uses a detection signal from the first motor angle sensor 61 to obtain a first motor number of revolutions Nmg1, which is the rotation speed of the rotor 53*a* of the first motor generator 53. The second control device 120 uses a detection signal from the second motor angle sensor 62 to obtain a second motor number of revolutions Nmg2, which is the rotation speed of rotor 55*a* of the second motor generator 55. The second control device 120 repeatedly performs the motor rotation speed acquisition process M21 at predetermined intervals to calculate the first motor number of revolutions Nmg1 and the second motor number of revolutions Nmg2.

The second control device 120 performs a first motor control process M22 for controlling the first motor generator 53. During the first motor control process M22, the second control device 120 uses the first motor number of revolutions Nmg1 to control the first inverter 11 for the first motor generator 53. The second control device 120 also obtains a first motor current value Img1, which is a value indicating the current flowing through the first motor generator 53.

The second control device 120 performs an information acquisition process M23 for calculating and obtaining information transmitted to the first control device 110. In the present embodiment, the information acquisition process M23 includes a first motor torque acquisition process M231, a motor angular velocity acquisition process M232, and an input shaft angular velocity calculation process M233.

During the first motor torque acquisition process M231, the second control device 120 obtains a first motor torque Tmg1, which is the output torque of the first motor generator 53. In the present embodiment, the second control device 120 obtains a calculated value of the output torque of the first motor generator 53 as the first motor torque Tmg1 from the first motor current value Img1 obtained in the first motor control process M22.

The second control device 120 repeatedly performs the first motor torque acquisition process M231 at predetermined intervals. For example, the second control device 120 performs the first motor torque acquisition process M231 to obtain the first motor torque Tmg1 whenever first control device 110 transmits a different crank counter CNTcr.

During the motor angular velocity acquisition process M232, the second control device 120 obtains a first motor angular velocity ωmg1, which is the angular velocity of the rotor 53*a* of the first motor generator 53. The second control device 120 obtains a second motor angular velocity ωmg2, which is the angular velocity of the rotor 55*a* of the second motor generator 55. In the present embodiment, the second control device 120 uses the first motor number of revolutions Nmg1 to obtain the first motor angular velocity ωmg1 and uses the second motor number of revolutions Nmg2 to obtain the second motor angular velocity ωmg2. For example, the second control device 120 obtains the first motor angular velocity ωmg1 by multiplying the first motor number of revolutions Nmg1 by a ωefficient and obtains the second motor angular velocity ωmg2 by multiplying the second motor number of revolutions Nmg2 by a ωefficient.

The second control device 120 performs the motor angular velocity acquisition process M232 at predetermined intervals. For example, the second control device 120 performs the motor angular velocity acquisition process M232 to obtain the first motor angular velocity ωmg1 and the second motor angular velocity ωmg2 whenever first control device 110 transmits a different crank counter CNTcr.

As described above, the first motor angle sensor 61 corresponds to the second sensor in the present embodiment. Thus, the first motor angular velocity ωmg1 corresponds to a transmitting device angular velocity that is obtained from a detection signal from the first motor angle sensor 61. Further, the motor angular velocity acquisition process M232 for obtaining the first motor angular velocity ωmg1 corresponds to a transmitting device angular velocity acquisition process.

During the input shaft angular velocity calculation process M233, the second control device 120 calculates an input shaft angular velocity ωinp, which is the angular velocity of the input shaft 51 of the drive force transmitting device 50. Specifically, the second control device 120 uses the first motor number of revolutions Nmg1 and the second motor number of revolutions Nmg2, which are obtained in the motor rotation speed acquisition process M21, to calculate the input shaft angular velocity ωinp. For example, the second control device 120 calculates an input shaft rotation number Ninp by substituting the first motor number of revolutions Nmg1 and the second motor number of revolutions Nmg2 into the following equation (Equation 1). In the equation (Equation 1), ρ represents the gear ratio of the planetary gear mechanism 52. The gear ratio ρ of the planetary gear mechanism 52 represents a value obtained by dividing the number of teeth of the sun gear 52*s* by the number of teeth of the ring gear 52*r*. Gr represents the gear ratio of the gear mechanism 54 of the drive force transmitting device 50.

$$Ninp = \frac{(\rho \cdot Nmg1 + Gr \cdot Nmg2)}{(1+\rho)} \quad \text{(Equation 1)}$$

The second control device 120 calculates the input shaft angular velocity ωinp by substituting the input shaft rotation number Ninp into the following equation (Equation 2).

$$\omega inp = 2\pi \cdot \frac{Ninp}{60} \quad \text{(Equation 2)}$$

Processes performed by the first control device 110 will now be described.

The first control device 110 performs a crank counter deriving process M11 for deriving the crank counter CNTcr. Specifically, the first control device 110 monitors a crank angle that is the rotation angle of the crankshaft 21 based on a detection signal from the crank angle sensor 31. The first control device 110 increments the crank counter CNTcr by 1 each time the crank angle increases by the predetermined angle. The first control device 110 resets the crank counter CNTcr to 0 when one cycle of the engine 20 ends.

The first control device 110 performs an ignition time adjustment process M12 for varying ignition times TMi in accordance with an operation state of the engine 20. For example, in a case where the engine 20 is warmed, the first control device 110 advances the ignition times TMi from a case where the engine 20 is not warmed. Alternatively, for example, the first control device 110 may retard the ignition time TMi of one of the cylinders 22 so that the engine torque Te is reduced at a time point when combustion is performed in the one cylinder 22. The first control device 110 controls the ignition devices 26 based on ignition times TMi adjusted in the ignition time adjustment process M12.

The first control device 110 performs an engine angular velocity acquisition process M13 for obtaining an engine angular velocity ωe, which is the angular velocity of the crankshaft 21. During the engine angular velocity acquisition process M13, the first control device 110 uses a detection signal from the crank angle sensor 31 to calculate an engine rotation number Ne, which is the rotation speed of the crankshaft 21. The engine angular velocity acquisition process M13 includes a first sensor detection signal acquisition process that obtains a detection signal from the crank angle sensor 31. The first control device 110 obtains the engine angular velocity ωe by multiplying the engine rotation number Ne by a ωefficient. When a Hilbert process, which will be described later, is performed on a detection signal from the crank angle sensor 31 (S304: YES), the engine angular velocity acquisition process M13 corresponds to a first rotation angle deriving process and a first angular velocity deriving process. When the Hilbert process is not performed on the detection signal from the crank angle sensor 31 (S304: NO), the engine angular velocity acquisition process M13 corresponds to a second rotation angle deriving process and a second angular velocity deriving process.

The first control device 110 performs the engine angular velocity acquisition process M13 at predetermined intervals. For example, the first control device 110 performs the engine angular velocity acquisition process M13 and obtains the engine angular velocity we whenever the crank counter CNTcr changes.

How the engine angular velocity ωe is obtained will now be described in detail.

The engine torque Te calculated in an engine torque calculation process M17, which will be described later, is input to the engine angular velocity acquisition process M13. The first control device 110 calculates an engine torque difference, which is a difference among engine torques Te at time points when the cylinders 22 perform combustion. That is, the first control device 110 performs an engine torque difference calculation process. For example, the first control device 110 may calculate an engine torque average value, which is the average value of engine torques Te at time points when each cylinder 22 performs combustion. The engine torque difference may be a difference among the engine torque average values of the cylinders 22.

When the engine torque difference is greater than or equal to a threshold value, the first control device 110 performs a torque reduction process on one of the cylinders 22 that generates a larger engine torque Te than the other cylinders 22. This is because when the engine torque difference is greater than or equal to the threshold value, a resonance effect torque Tdmp, which will be described later, may adversely affect the calculation of the engine torque Te. In the present embodiment, the torque reduction process retards the ignition time TMi of the cylinder 22 that generates a larger engine torque Te. The cylinder 22 that generates the larger engine torque Te refers to one of the cylinders 22 that performs combustion at a time point when the larger engine torque Te is generated. The first control device 110 performs the Hilbert process, which will be described later, on condition that an engine torque difference is less than a threshold value.

The first control device 110 performs a rotation angle deriving process that derives a value of the rotation angle of the crankshaft 21 by each specified angle that is smaller than the predetermined angle by performing the Hilbert process on a detection signal from the crank angle sensor 31. Then, the first control device 110 uses the value of the rotation angle of the crankshaft 21 by the specified angle to perform an angular velocity deriving process that derives the angular velocity of the crankshaft 21 as the engine angular velocity cue. When the first control device 110 does not perform the Hilbert process, the first control device 110 uses a value of the rotation angle of the crankshaft 21 by the predetermined angle to derive the angular velocity of the crankshaft 21 as the engine angular velocity ωe.

The Hilbert process will now be described.

A detection signal from the crank angle sensor 31 input to the engine angular velocity acquisition process M13 is converted from a time domain signal to a frequency domain signal through a fast Fourier transformation (FFT). The converted frequency domain signal passes through a band-pass filter. This removes noise and harmonics. The signal from which noise and harmonics have been removed is converted from a frequency domain signal to a time domain signal through an inverse fast Fourier transformation (iFFT). The converted time domain signal is phase shifted by 90 degrees and divided into a real part signal and an imaginary part signal. The 90-degree phase shift is referred to as the Hilbert transform. A detection signal from the crank angle sensor 31 is measured as a mapping a of a complex number A, which has a size and a phase, to the real axis. The 90-degree phase shift is a process that calculates a mapping b of the complex number A to the imaginary axis by phase-shifting the complex number A by 90 degrees. That is, the Hilbert transform calculates the complex number A, which has the mapping a on the real part and the mapping b on the imaginary part. Then, a signal proportional to the rotation angle of the crankshaft 21, i.e., an angle formed by a complex vector and the real axis is calculated. A rotational fluctuation is calculated from the calculated angle. The use of the 90-degree phase shift calculates a phase. The phase is proportional to the rotation angle of the crankshaft 21. Thus, obtaining the phase with respect to time provides a rotational fluctuation of the crankshaft 21. Thus, phase data is continuously obtained at all times and allows for the detection of a rotational fluctuation with higher resolution.

Figure 3:
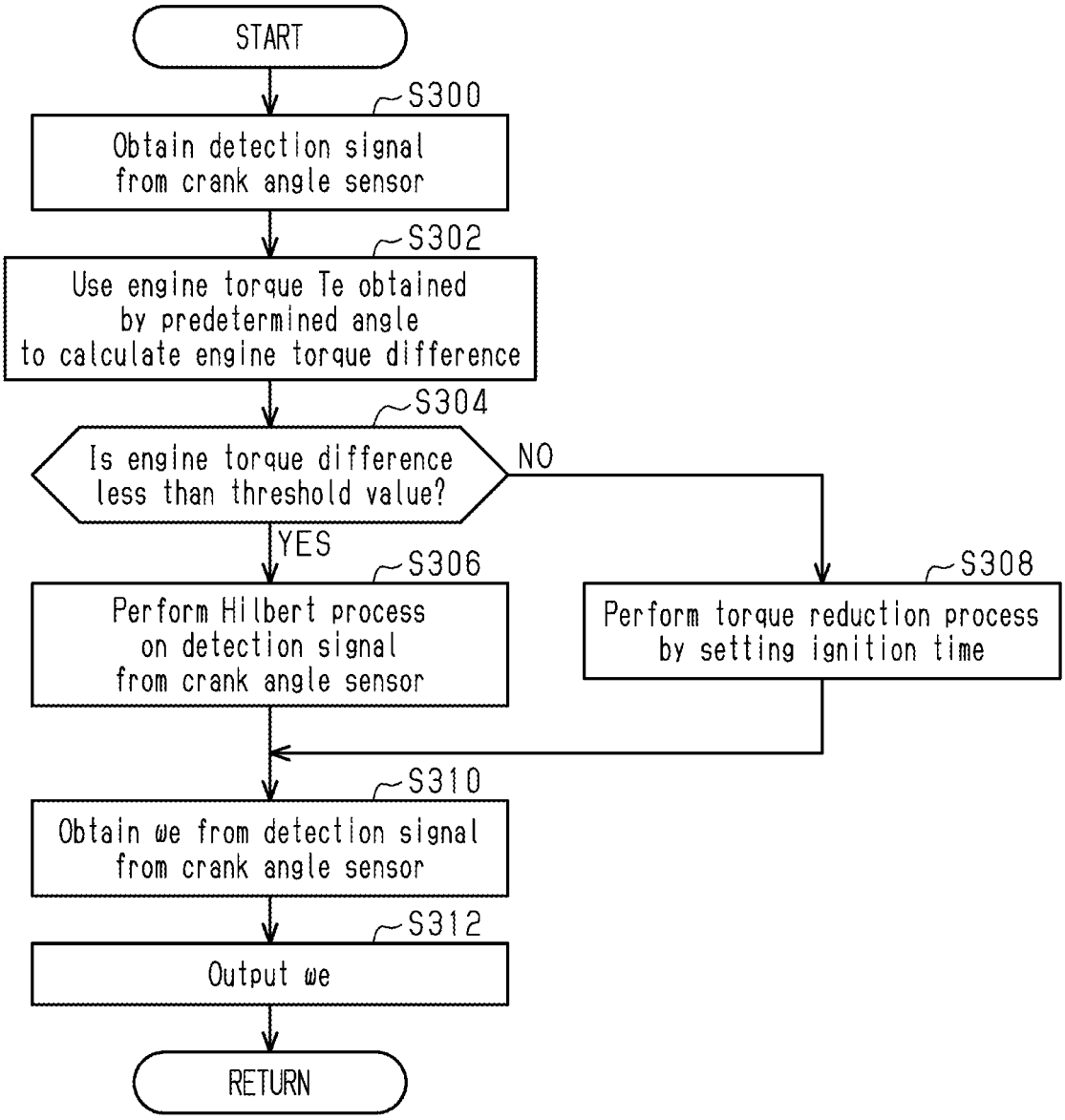
FIG. 3 is a flowchart of an engine angular velocity acquisition process shown in FIG. 2.

The engine angular velocity acquisition process M13 will now be described with reference to the flowchart of FIG. 3. The first control device 110 performs the engine angular velocity acquisition process M13 at predetermined intervals. For example, the first control device 110 performs the engine angular velocity acquisition process M13 whenever the crank counter CNTcr changes.

In step S300, the first control device 110 obtains a detection signal from the crank angle sensor 31. In step S302, the first control device 110 uses the engine torque Te, which is obtained by the predetermined angle, to calculate the engine torque difference. That is, the engine torque difference is calculated from the detection signal from the crank angle sensor 31 when the Hilbert process is not performed. The process that calculates the engine torque Te corresponds to a second engine torque calculation process.

In step S304, the first control device 110 determines whether the engine torque difference is less than a threshold value.

When the engine torque difference is less than the threshold value (step S304: YES), the first control device 110 proceeds to step S306. In step S306, the first control device 110 performs the Hilbert process on the detection signal from the crank angle sensor 31.

When the engine torque difference is greater than or equal to the threshold value (step S304: NO), the first control device 110 proceeds to step S308. In step S308, the first control device 110 performs the torque reduction process by setting the ignition time TMi. The set ignition time TMi is maintained until the ignition time TMi is set again. Thus, suitable ignition times TMi are learned when the engine angular velocity acquisition process M13 is repeatedly performed. The use of the learned ignition times TMi achieves a state in which the engine torque difference is less than the threshold value.

In step S310, the first control device 110 uses the detection signal from the crank angle sensor 31 to obtain the engine angular velocity ωe. In step S312, the first control device 110 outputs the engine angular velocity ωe.

Figure 2:
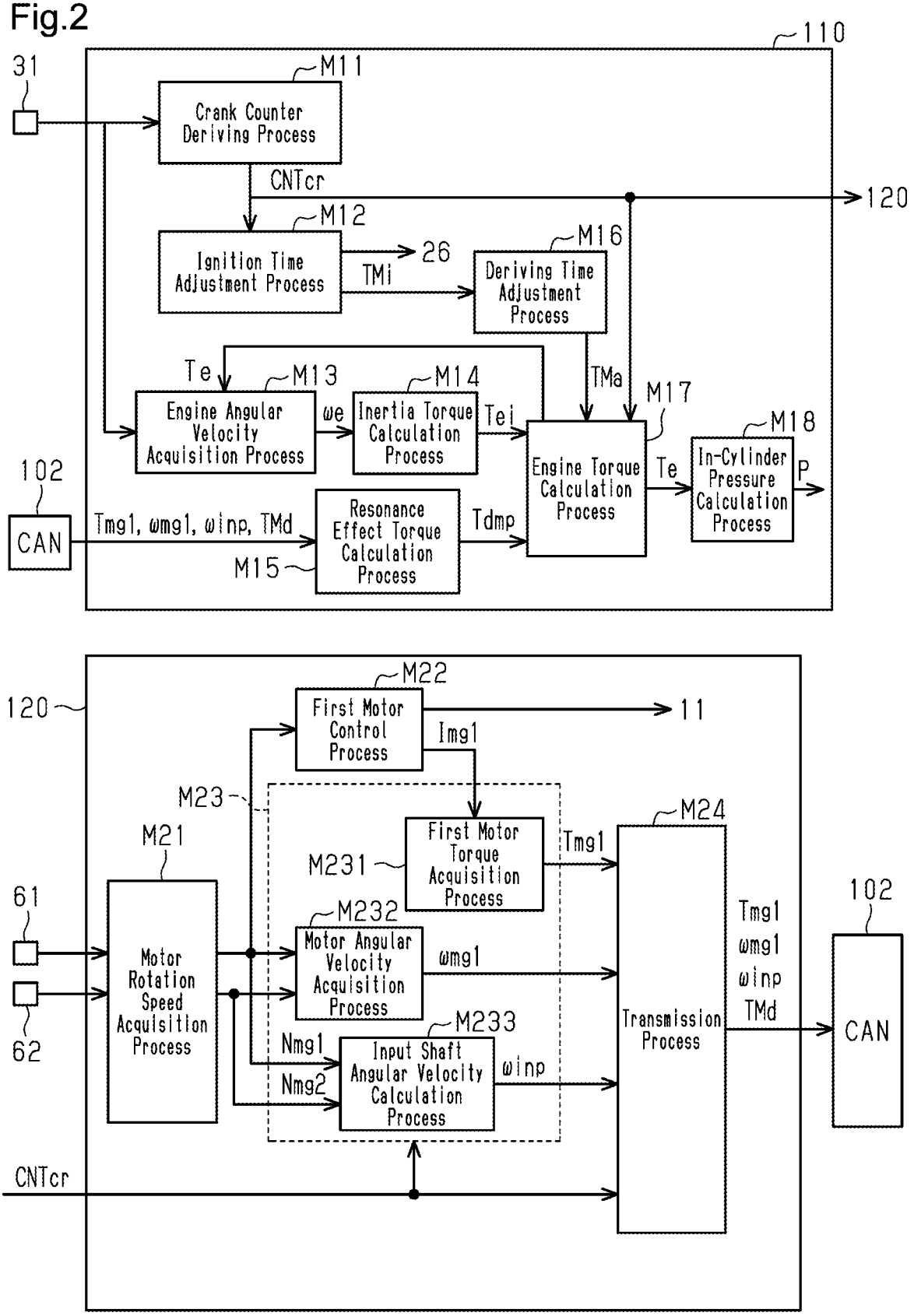
FIG. 2 is a block diagram illustrating processes performed by a first control device and processes performed by a second control device in the controller for a vehicle in the first embodiment.

As shown in FIG. 2, the first control device 110 performs an inertia torque calculation process M14 for calculating an engine inertia torque Tei, which is an inertia torque of the engine 20. For example, the first control device 110 calculates the engine inertia torque Tei by substituting the engine angular velocity ωe, which is obtained in the engine angular velocity acquisition process M13, into the following equation (Equation 3). In the equation (Equation 3), Ie represents the moment of inertia of the engine 20. That is, the first control device 110 calculates the engine inertia torque Tei from the time derivative of the engine angular velocity ωe. When the Hilbert process is performed on the detection signal from the crank angle sensor 31 (S304: YES), the inertia torque calculation process M14 corresponds to a first inertia torque calculation process. When the Hilbert process is not performed on the detection signal from the crank angle sensor 31 (S304: NO), the inertia torque calculation process M14 corresponds to a second inertia torque calculation process. The second inertia torque calculation process calculates a second engine inertia torque.

$$Tei = Ie \cdot \frac{d\omega e}{dt} \quad \text{(Equation 3)}$$

The first control device 110 performs the inertia torque calculation process M14 at predetermined intervals. For example, the first control device 110 performs the inertia torque calculation process M14 and obtains the engine inertia torque Tei whenever the crank counter CNTcr changes.

An output of the engine 20 is input to the input shaft 51 of the drive force transmitting device 50 via the damper 40. When the engine torque Te varies, the damper 40 may generate torsional vibration, and resonance resulting from the torsional vibration may be generated in the input shaft 51. When such resonance is generated in the input shaft 51, torque resulting from the resonance is input to the crankshaft 21. In the present embodiment, torque resulting from the resonance generated in the drive force transmitting device 50 is referred to as a resonance effect torque.

The first control device 110 performs a resonance effect torque calculation process M15 for calculating a resonance effect torque Tdmp. During the resonance effect torque calculation process M15, the first control device 110 calculates the resonance effect torque Tdmp from the first motor torque Tmg1, the first motor angular velocity ωmg1, and the input shaft angular velocity ωinp, which are received through the CAN communication line 102. For example, the first control device 110 calculates the resonance effect torque Tdmp by substituting the first motor torque Tmg1, the first motor angular velocity ωmg1, and the input shaft angular velocity ωinp into the following equation (Equation 4). In the equation (Equation 4), Iinp represents the moment of inertia of the input shaft 51, and Ig represents the moment of inertia of the first motor generator 53. In accordance with the equation (Equation 4), the first control device 110 calculates the resonance effect torque Tdmp from the time derivative of the input shaft angular velocity ωinp and the time derivative of the first motor angular velocity ωmg1.

$$Tdmp = linp \cdot \frac{d\omega inp}{dt} + \frac{(I+\rho)}{\rho} \cdot \left(Ig \cdot \frac{d\omega mgl}{dt} - Tmgl\right) \quad \text{(Equation 4)}$$

The first control device 110 performs the resonance effect torque calculation process M15 at predetermined intervals. For example, the first control device 110 performs the resonance effect torque calculation process M15 to calculate the resonance effect torque Tdmp whenever receiving the above information through the CAN communication line 102.

The first control device 110 performs a deriving time adjustment process M16. Specifically, the first control device 110 adjusts a deriving time TMa in accordance with the ignition time TMi adjusted in the ignition time adjustment process M12. For example, when the ignition time TMi is advanced, the first control device 110 advances the deriving time TMa. In this case, the deriving time TMa may be set to a time that is retarded from the ignition time TMi by a predetermined latency period ATM. The latency period ATM is set to a period that is less than a half of one cycle of the engine 20.

At the ignition time TMi, an air-fuel mixture is burned inside the cylinder 22 by an action of the ignition device 26. The combustion of the air-fuel mixture increases the actual value of the engine torque Te. When the actual value reaches its peak, the actual value of the engine torque Te decreases until the combustion of a next air-fuel mixture starts inside the cylinder 22. That is, the effect of the combustion inside the cylinder 22 greatly influences the actual value of the engine torque Te immediately after the ignition time TMi. Then, the effect of the combustion inside the cylinder 22 increasingly loses its influence on the actual value of the engine torque Te as time elapses from the ignition time TMi. The latency period ATM is set so that the deriving time TMa is set to a period during which the effect of the combustion inside the cylinder 22 greatly influences the actual value of the engine torque Te.

The first control device 110 performs the engine torque calculation process M17 for calculating the engine torque Te. Specifically, the first control device 110 calculates the sum of the engine inertia torque Tei, which is calculated in the inertia torque calculation process M14, and the resonance effect torque Tdmp, which is calculated in the resonance effect torque calculation process M15, as the engine torque Te. In the present embodiment, the first control device 110 calculates the engine torque Te from the deriving time TMa, which is adjusted in the deriving time adjustment process M16, and the crank counter CNTcr.

Figure 4:
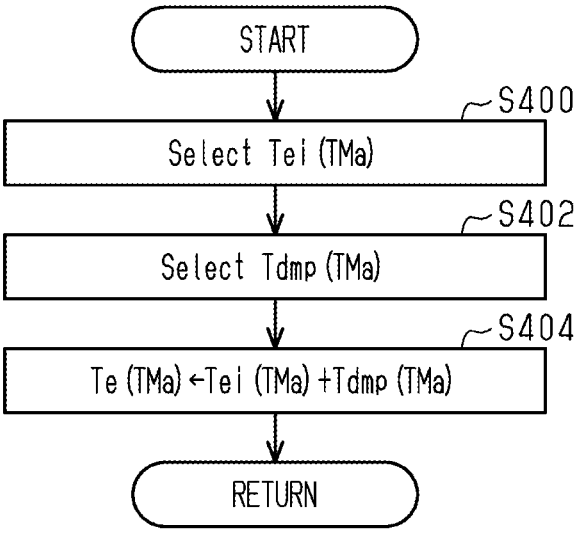
FIG. 4 is a flowchart of an engine torque calculation process performed by the controller for a vehicle in the first embodiment.

The engine torque calculation process M17 will now be described with reference to FIG. 4.

In step S400, the first control device 110 selects an engine inertia torque Tei(TMa), which is calculated from the engine angular velocity ωe derived at a given deriving time TMa. The engine inertia torque Tei(TMa) is selected from engine inertia torques Tei, which are calculated in the inertia torque calculation process M14. That is, the first control device 110 selects, as the engine inertia torque Tei(TMa), one of the engine inertia torques Tei that is derived when the crank counter CNTcr is equal to a value indicating the deriving time TMa.

In step S402, the first control device 110 selects a resonance effect torque Tdmp(TMa), which is calculated from the first motor angular velocity ωmg1 derived at the deriving time TMa. The resonance effect torque Tdmp(TMa) is selected from engine inertia torques Tei, which are calculated in the resonance effect torque calculation process M15. Specifically, the first control device 110 selects, as the resonance effect torque Tdmp(TMa), one of the resonance effect torques Tdmp that is calculated from the first motor angular velocity ωmg1 when the information acquisition time TMd is equal to a given deriving time TMa.

In step S404, the first control device 110 calculates the sum of the engine inertia torque Tei(TMa) and the resonance effect torque Tdmp(TMa) as an engine torque Te(TMa). That is, the first control device 110 calculates the engine torque Te(TMa) at the deriving time TMa. Then, the first control device 110 ends the engine torque calculation process M17. When the Hilbert process is performed on a detection signal from the crank angle sensor 31 (S304: YES), the engine torque calculation process M17 corresponds to a first engine torque calculation process. When the Hilbert process is not performed on the detection signal from the crank angle sensor 31 (S304: NO), the engine torque calculation process M17 corresponds to the second engine torque calculation process.

As shown in FIG. 2, the first control device 110 calculates an in-cylinder pressure P in an in-cylinder pressure calculation process M18. The engine torque Te or the like calculated in the engine torque calculation process M17 is input to the in-cylinder pressure calculation process M18.

Figure 5:
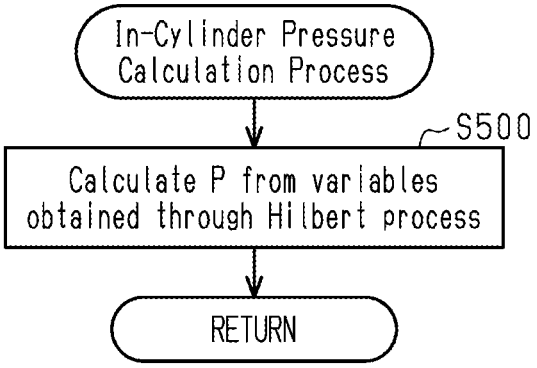
FIG. 5 is a flowchart of an in-cylinder pressure calculation process performed by the controller for a vehicle in the first embodiment.

As shown in FIG. 5, in step S500, the first control device 110 calculates the in-cylinder pressure P, which is the pressure of the cylinders 22, from variables obtained through the Hilbert process. Specifically, the first control device 110 calculates the in-cylinder pressure P in accordance with the following equation (Equation 5).

$$P(\theta) = \frac{\pi}{180} \frac{1}{\frac{dV(\theta)}{d\theta}} (Te(\theta) + Tfrq(\theta)) + \left(\frac{180}{\pi}\right)^2 \frac{M}{A^2} \omega e \left[\omega e \cdot \frac{d^2V(\theta)}{d\theta^2} + \frac{d\omega e}{d\theta} \cdot \frac{dV(\theta)}{d\theta}\right] \quad \text{(Equation 5)}$$

In the equation (Equation 5), θ represents a crank angle, V represents cylinder volume, Tfrq represents a friction torque, M represents the sum of the mass of portions reciprocating as the engine 20 is operated, and A represents the projected area of top surfaces of a piston. The friction torque acts in the direction in which the rotation of the crankshaft 21 is hindered. The friction torque may change in accordance with the engine rotation number Ne and the intake air amount GA.

The first control device 110 performs a process that controls the engine 20 in accordance with the calculated in-cylinder pressure P. For example, the first control device 110 derives a maximum in-cylinder pressure Pmax, a heat generation rate dQ/dθ, and the like from the calculated in-cylinder pressure P. The first control device 110 uses the maximum in-cylinder pressure Pmax, the heat generation rate dQ/dθ, and the like to perform the process that controls the engine 20. For example, the first control device 110 performs a feedback control and improves combustion efficiency.

Operation and Advantages of the First Embodiment (1-1) The crank angle sensor 31 outputs a detection signal indicating that the crankshaft 21 has rotated by a predetermined angle each time the crankshaft 21 rotates by the predetermined angle. Unlike the present embodiment, when a detection signal from the crank angle sensor 31 is used without modification to calculate the engine torque Te, the obtained engine torque Te has resolution that corresponds to the predetermined angle. In contrast, according to the present embodiment, the controller 100 derives a value of the rotation angle of the crankshaft 21 by each specified angle that is smaller than the predetermined angle by performing the Hilbert process. This increases the resolution of the engine torque Te, which is calculated from the rotation angle of the crankshaft 21.

(1-2) A greater engine torque difference is likely to increase the resonance effect torque Tdmp. The greater resonance effect torque Tdmp indicates greater disturbance overlapping the engine inertia torque Tei. That is, when the resonance effect torque Tdmp increases, the combustion state of the engine 20 is difficult to monitor from the engine torque Te. In the case of the greater resonance effect torque Tdmp, even when the engine torque Te is calculated to have a high resolution through the Hilbert process, the calculated engine torque Te is not suitable. In the present embodiment, the controller 100 performs the Hilbert process on condition that an engine torque difference is less than the threshold value. The threshold value is set in advance to suitably calculate the engine torque Te with a high resolution through the Hilbert process. Thus, the Hilbert process is not performed in the case of a greater engine torque difference. That is, the present embodiment restricts unnecessarily performed Hilbert processes. The present embodiment further avoids the calculation of an unsuitable engine torque Te.

(1-3) When the engine torque difference is greater than or equal to the threshold value, the controller 100 performs the torque reduction process on one of the cylinders 22 that generates a larger engine torque Te. Then, the controller 100 performs the Hilbert process on condition that the engine torque difference is less than the threshold value. This increases opportunities for performing the Hilbert process compared to the case in which the torque reduction process is not performed.

(1-4) To calculate the in-cylinder pressure P from a calculated engine torque Te, the engine torque Te needs to have a higher resolution. This is due to the following reason. The in-cylinder pressure P greatly varies in a very short period from the combustion of an air-fuel mixture inside the cylinder 22. A fluctuation in the in-cylinder pressure P at an early stage of combustion needs to be observed in order to monitor the state of combustion based on the in-cylinder pressure P to control the engine 20.

The controller 100 derives a value of the rotation angle of the crankshaft 21 by each specified angle that is smaller than the predetermined angle by performing the Hilbert process. The controller 100 calculates the in-cylinder pressure P from the calculated engine torque Te. This observes the fluctuation in the in-cylinder pressure P at the early stage of combustion.

Second Embodiment

The controller 100 for a vehicle according to a second embodiment will now be described with reference to FIGS. 6 and 7. The configuration of the controller 100 for a vehicle common to the first embodiment and the second embodiment will not be described. In the controller 100 for a vehicle in the first embodiment, the first control device 110 calculates the engine torque Te. In contrast, the controller 100 for a vehicle in the second embodiment, the second control device 120 calculates the engine torque Te. In particular, the first control device 110 receives a detection signal from the crank angle sensor 31 and transmits the detection signal of the crank angle sensor 31 to the second control device 120.

Processes performed by the first control device 110 and the second control device 120 to calculate the engine torque Te will now be described with reference to FIG. 6.

The first control device 110 performs a transmission process M19. During the transmission process M19, the first control device 110 transmits information necessary for the second control device 120 to calculate the engine torque Te to the second control device 120. A detection signal from the crank angle sensor 31 is a rectangular pulse signal, and the first control device 110 converts the rectangular pulse signal to a corresponding sine wave signal. In the present embodiment, the first control device 110 outputs the sine wave signal, which is obtained by converting the detection signal from the crank angle sensor 31, and the deriving time TMa in association with the information acquisition time TMd to the CAN communication line 102. In the present embodiment, the first control device 110 outputs the crank counter CNTcr, measured at a time point when the transmitted detection signal from the crank angle sensor 31 is obtained, as the information acquisition time TMd to the CAN communication line 102.

Figure 6:
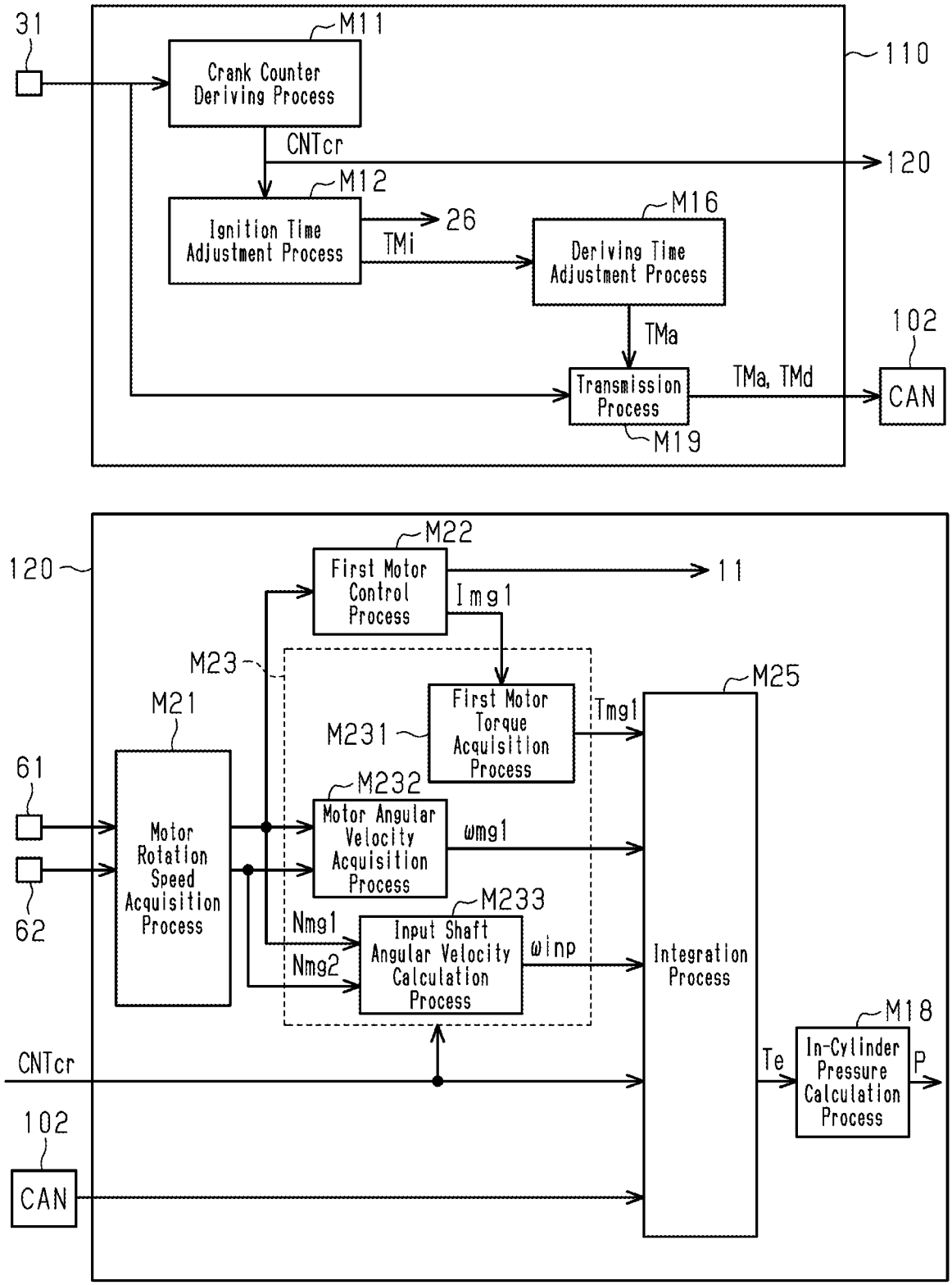
FIG. 6 is a block diagram illustrating processes performed by the first control device and processes performed by the second control device in the controller for a vehicle according to a second embodiment.

As shown in FIG. 6, the second control device 120 performs an integration process M25 for calculating the engine torque Te. The integration process M25 is for calculating the engine inertia torque Tei and the resonance effect torque Tdmp and the sum of the engine inertia torque Tei and the resonance effect torque Tdmp as the engine torque Te. FIG. 7 is a block diagram illustrating details of the integration process M25 shown in FIG. 6. The integration process M25 will now be described.

Figure 7:
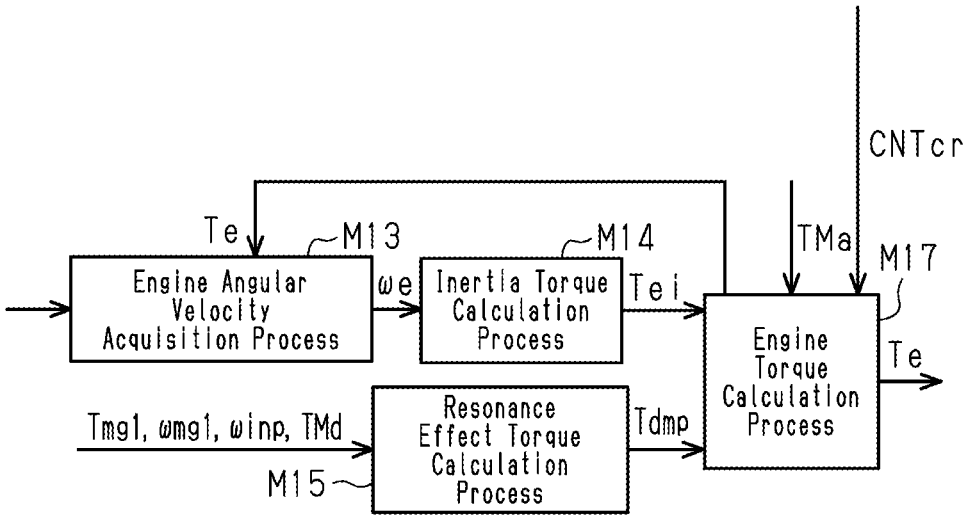
FIG. 7 is a block diagram illustrating details of an integration process shown in FIG. 6.

As shown in FIG. 7, in the engine angular velocity acquisition process M13, the second control device 120 receives the sine wave signal, which is converted from the detection signal from the crank angle sensor 31, through the CAN communication line 102. In the engine angular velocity acquisition process M13, the second control device 120 performs the same process as the engine angular velocity acquisition process M13 in the first embodiment. That is, the second control device 120 receives the sine wave signal, which is converted from the detection signal from the crank angle sensor 31, and outputs the engine angular velocity ωe. In the controller 100 for a vehicle in the first embodiment, the engine torque Te, which is output from the engine torque calculation process M17 performed by the first control device 110, is input to the engine angular velocity acquisition process M13. In the controller 100 for a vehicle in the second embodiment, the engine torque Te, which is output from the engine torque calculation process M17 performed by the second control device 120, is input to the engine angular velocity acquisition process M13. As described in the first embodiment, the Hilbert process is performed in the engine angular velocity acquisition process M13. That is, in the present embodiment, the second control device 120 instead of the first control device 110 performs the Hilbert process. Thus, the second control device 120 performs the Hilbert process on the sine wave signal.

The second control device 120 performs the same process as the inertia torque calculation process M14 in the first embodiment. Specifically, the second control device 120 calculates the engine inertia torque Tei from the engine angular velocity ωe output from the engine angular velocity acquisition process M13.

The second control device 120 performs the same process as the resonance effect torque calculation process M15 in the first embodiment. In the controller 100 for a vehicle in the first embodiment, the first control device 110 calculates the resonance effect torque Tdmp from the first motor torque Tmg1, the first motor angular velocity ωmg1, and the input shaft angular velocity ωinp, which are received through the CAN communication line 102. In contrast, in the controller 100 for a vehicle in the second embodiment, the second control device 120 calculates the resonance effect torque Tdmp from the first motor torque Tmg1, the first motor angular velocity ωmg1, and the input shaft angular velocity ωinp calculated by the second control device 120.

The second control device 120 performs the same process as the engine torque calculation process M17 in the first embodiment. Specifically, the second control device 120 calculates the sum of the engine inertia torque Tei, which is calculated in the inertia torque calculation process M14, and the resonance effect torque Tdmp, which is calculated in the resonance effect torque calculation process M15, as the engine torque Te. As shown in FIG. 6, the second control device 120 calculates the in-cylinder pressure P in the in-cylinder pressure calculation process M18. The engine torque Te or the like calculated in the integration process M25 is input to the in-cylinder pressure calculation process M18.

Operation and Advantages of the Second Embodiment

The controller 100 for a vehicle in the second embodiment has the following advantages in addition to the advantages set forth in (1-1) to (1-4).

(2-1) The second control device 120 receives a detection signal from the first motor angle sensor 61, which is configured to detect the rotation angle of the input shaft 51 or the rotor 53*a*, and performs the Hilbert process. The second control device 120 calculates the sum of the resonance effect torque Tdmp and the engine inertia torque Tei as the engine torque Te. The second control device 120 can use the information acquisition time TMd to easily synchronize a detection signal from the crank angle sensor 31 with a detection signal from the first motor angle sensor 61.

(2-2) A rectangular pulse signal that is a detection signal from the crank angle sensor 31 is converted to a sine wave signal. The Hilbert process uses a Fourier transform. The sine wave is more easily converted to a Fourier transform than a rectangular pulse signal. Thus, the Hilbert process can be easily performed in the present embodiment.

Modifications

The followings are modifications commonly applicable to the above embodiments. The modifications can be combined as long as the combined modifications remain technically consistent with each other.

In the first embodiment, the use of the information acquisition time TMd solves the problem of delay occurring between a time at which the second control device 120 transmits the information and a time at which the first control device 110 receives the information. The information acquisition time TMd may be omitted when the problem of delay is negligible.

In the first embodiment and the second embodiment, a calculated value of the output torque of the first motor generator 53 is obtained as the first motor torque Tmg1. Instead, an instruction value of the output torque for the first motor generator 53 may be obtained as the first motor torque Tmg1.

In the first embodiment and the second embodiment, when the drive force transmitting device 50 includes a sensor that detects the rotation angle of the input shaft 51 of the drive force transmitting device 50, an angular velocity calculated from an output signal of the sensor may be used as the input shaft angular velocity ωinp.

In each embodiment, the deriving time TMa does not need to be varied. In this case, the engine 20 does not need to be of a spark-ignition type.

The structure of the drive force transmitting device 50 described in the first embodiment may be modified. For example, the drive force transmitting device 50 may include a single motor generator.

In the first embodiment and the second embodiment, the torque reduction process retards the ignition time TMi of the cylinder 22 that generates a larger engine torque Te. Instead, the torque reduction process may reduce the amount of fuel injection for the cylinder 22 that generates the larger engine torque Te.

In the first embodiment and the second embodiment, when the engine torque difference is greater than or equal to the threshold value, the controller 100 performs the torque reduction process on one of the cylinders 22 that generates a larger engine torque Te than the other cylinders 22. Instead or in addition, when the engine torque difference is greater than or equal to the threshold value, the controller 100 may perform a torque increase process on one of the cylinders 22 that generates a smaller engine torque Te than the other cylinders 22. The torque increase process may advance the ignition time TMi of the cylinder 22 that generates the smaller engine torque Te. The torque increase process may increase the amount of fuel injection for the cylinder 22 that generates the smaller engine torque Te.

In the first embodiment and the second embodiment, the controller 100 performs the engine angular velocity acquisition process M13 at predetermined intervals. Thus, whenever the engine torque difference is greater than or equal to the threshold value, the torque reduction process is performed (refer to FIG. 3). Instead, the torque reduction process may be performed only when the in-cylinder pressure calculation process M18 is required. That is, the torque reduction process may be performed where necessary.

In the second embodiment, a detection signal from the crank angle sensor 31 is a rectangular pulse signal, and the first control device 110 converts the rectangular pulse signal to a corresponding sine wave signal. The process that converts the rectangular pulse signal to the corresponding sine wave signal may be omitted.

When the hybrid electric vehicle 10 travels on a bad road, a disturbance may be input from the axle 74*a*. This may affect the in-cylinder pressure calculation process M18. In this case, the disturbance input from the axle 74*a* seems to occur as damper torsional resonance. The controller 100 may detect the damper torsional resonance from the difference between the engine angular velocity ωe and the input shaft angular velocity ωinp. When the damper torsional resonance is greater than a predetermined value, the controller 100 may stop leaning ignition times TMi or the like.

The controller 100 is not limited to a device that includes a CPU and ROM and executes software processing. For example, a dedicated hardware circuit (such as ASIC) may be provided that executes at least part of the software processes executed in the above-described embodiment. That is, the controller 100 may be modified to have any one of the following configurations (a) to (c). (a) A configuration including a processor that executes all of the above-described processes according to programs and a program storage device such as ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software executing devices each including a processor and a program storage device and a plurality of dedicated hardware circuits may be provided. That is, the above processes may be executed by processing circuitry that includes at least one of a set of one or more software executing devices or a set of one or more dedicated hardware circuits. The program storage device, or computer readable media, includes any type of media that are accessible by general-purpose computers and dedicated computers.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for a vehicle, the vehicle including an engine with cylinders, a damper connected to a crankshaft of the engine, a drive force transmitting device including an input shaft connected to the damper and a rotating body configured to rotate in synchronization with the input shaft, a first sensor configured to output a detection signal indicating that the crankshaft has rotated by a predetermined angle each time the crankshaft rotates by the predetermined angle, and a second sensor configured to detect a rotation angle of the input shaft or the rotating body, the controller comprising: processing circuitry, wherein the processing circuitry is configured to perform:

a first sensor detection signal acquisition process that obtains a detection signal from the first sensor;

a first rotation angle deriving process that derives a value of a rotation angle of the crankshaft by each specified angle that is smaller than the predetermined angle by performing a Hilbert process on the detection signal from the first sensor;

a first angular velocity deriving process that derives an angular velocity of the crankshaft as an engine angular velocity from the value of the rotation angle of the crankshaft by each specified angle;

a first inertia torque calculation process that calculates an engine inertia torque from the engine angular velocity;

a transmitting device angular velocity acquisition process that obtains an angular velocity of the input shaft or the rotating body as a transmitting device angular velocity from a detection signal from the second sensor;

a resonance effect torque calculation process that calculates a resonance effect torque from the transmitting device angular velocity, the resonance effect torque resulting from resonance generated in the drive force transmitting device; and a first engine torque calculation process that calculates a sum of the resonance effect torque and the engine inertia torque as an engine torque that is an output torque of the engine.

2. The controller according to claim 1, wherein the processing circuitry is configured to perform:

a second rotation angle deriving process that derives a value of the rotation angle of the crankshaft by each predetermined angle without performing the Hilbert process on the detection signal from the first sensor;

a second angular velocity deriving process that derives an angular velocity of the crankshaft as an engine angular velocity from the value of the rotation angle of the crankshaft by each predetermined angle;

a second inertia torque calculation process that calculates a second engine inertia torque from the engine angular velocity, which is derived in the second angular velocity deriving process;

a second engine torque calculation process that calculates a sum of the resonance effect torque and the second engine inertia torque as a second engine torque that is an output torque of the engine; and an engine torque difference calculation process that calculates an engine torque difference, which is a difference among the second engine torques at time points when the cylinders perform combustion, and the processing circuitry is configured to perform the Hilbert process when the engine torque difference is less than a threshold value.

3. The controller according to claim 1, wherein the processing circuitry is configured to perform:

a second rotation angle deriving process that derives a value of the rotation angle of the crankshaft by each predetermined angle without performing the Hilbert process on the detection signal from the first sensor;

a second angular velocity deriving process that derives an angular velocity of the crankshaft as an engine angular velocity from the value of the rotation angle of the crankshaft by each predetermined angle;

a second inertia torque calculation process that calculates a second engine inertia torque from the engine angular velocity, which is derived in the second angular velocity deriving process;

a second engine torque calculation process that calculates a sum of the resonance effect torque and the second engine inertia torque as a second engine torque that is an output torque of the engine; and an engine torque difference calculation process that calculates an engine torque difference, which is a difference among the second engine torques at time points when the cylinders perform combustion, the processing circuitry is configured to perform a torque reduction process on one of the cylinders that generates a larger second engine torque than the other cylinders when the engine torque difference is greater than or equal to a threshold value, and the processing circuitry is configured to perform the Hilbert process when the engine torque difference is less than the threshold value.

4. The controller according to claim 1, wherein the processing circuitry includes a first control device configured to receive a detection signal from the first sensor and a second control device configured to receive a detection signal from the second sensor and communicate with the first control device, the first control device is configured to perform:

the first sensor detection signal acquisition process that obtains the detection signal from the first sensor; and a transmission process that transmits the detection signal obtained from the first sensor and an information acquisition time indicating when the detection signal from the first sensor is obtained to the second control device, the second control device is configured to perform:

the first rotation angle deriving process that derives a value of the rotation angle of the crankshaft by each specified angle that is smaller than the predetermined angle by performing the Hilbert process on the detection signal from the first sensor;

the first angular velocity deriving process that derives the engine angular velocity from the value of the rotation angle of the crankshaft by the specified angle;

the first inertia torque calculation process that calculates the engine inertia torque from the engine angular velocity;

the transmitting device angular velocity acquisition process that obtains the transmitting device angular velocity from a detection signal from the second sensor;

the resonance effect torque calculation process that calculates the resonance effect torque from the transmitting device angular velocity; and the first engine torque calculation process that calculates the sum of the resonance effect torque and the engine inertia torque as the engine torque that is the output torque of the engine, and the second control device is configured, in the first engine torque calculation process, to select the engine inertia torque from the value of the rotation angle of the crankshaft, which is derived at a given deriving time based on the information acquisition time received from the first control device, and calculate a sum of the selected engine inertia torque and the resonance effect torque calculated at the given deriving time as the engine torque.

5. The controller according to claim 4, wherein the detection signal from the first sensor is a rectangular pulse signal, the first control device is configured to convert the rectangular pulse signal to a corresponding sine wave signal and transmit the sine wave signal to the second control device, and the second control device is configured to perform the Hilbert process on the sine wave signal.

6. The controller according to claim 1, wherein the processing circuitry is configured to further perform:

an in-cylinder pressure calculation process that calculates an in-cylinder pressure that is a pressure of the cylinders from the engine torque calculated through the Hilbert process; and a process that controls the engine in accordance with the in-cylinder pressure.

7. A method for controlling a vehicle, the vehicle including an engine with cylinders, a damper connected to a crankshaft of the engine, a drive force transmitting device including an input shaft connected to the damper and a rotating body configured to rotate in synchronization with the input shaft, a first sensor configured to output a detection signal indicating that the crankshaft has rotated by a predetermined angle each time the crankshaft rotates by the predetermined angle, and a second sensor configured to detect a rotation angle of the input shaft or the rotating body, the method comprising:

a first sensor detection signal acquisition process that obtains a detection signal from the first sensor;

a first rotation angle deriving process that derives a value of a rotation angle of the crankshaft by each specified angle that is smaller than the predetermined angle by performing a Hilbert process on the detection signal from the first sensor;

a first angular velocity deriving process that derives an angular velocity of the crankshaft as an engine angular velocity from the value of the rotation angle of the crankshaft by each specified angle;

a first inertia torque calculation process that calculates an engine inertia torque from the engine angular velocity;

a transmitting device angular velocity acquisition process that obtains an angular velocity of the input shaft or the rotating body as a transmitting device angular velocity from a detection signal from the second sensor;

a resonance effect torque calculation process that calculates a resonance effect torque from the transmitting device angular velocity, the resonance effect torque resulting from resonance generated in the drive force transmitting device; and a first engine torque calculation process that calculates a sum of the resonance effect torque and the engine inertia torque as an engine torque that is an output torque of the engine.

* * * * *